US006896115B2

(12) United States Patent
Yu

(10) Patent No.: US 6,896,115 B2
(45) Date of Patent: May 24, 2005

(54) PAPER CURRENCY RECEIVER FOR TICKET VENDOR

(75) Inventor: Cheng-Kang Yu, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 350 days.

(21) Appl. No.: 10/122,201

(22) Filed: Apr. 16, 2002

(65) Prior Publication Data

US 2003/0192764 A1 Oct. 16, 2003

(51) Int. Cl.[7] ..... G07F 7/04
(52) U.S. Cl. ..... 194/206
(58) Field of Search ..... 194/206, 203, 194/207, 344, 350, 351; 232/62

(56) References Cited

U.S. PATENT DOCUMENTS 5,195,739 A * 3/1993 Watabe ..... 271/207
5,333,714 A * 8/1994 Watabe et al. ..... 194/206
5,421,443 A * 6/1995 Hatamachi et al. ..... 194/206
5,450,937 A * 9/1995 Ono et al. ..... 194/203
5,494,144 A * 2/1996 Izawa ..... 194/203
5,505,289 A * 4/1996 Watabe et al. ..... 194/206
5,657,846 A * 8/1997 Schwartz ..... 194/206
5,715,924 A * 2/1998 Takemoto et al. ..... 194/206
5,806,649 A * 9/1998 Walsh et al. ..... 194/203
6,105,747 A * 8/2000 Uemizo et al. ..... 194/203
6,412,619 B1 * 7/2002 Ito et al. ..... 194/206
6,457,586 B2 * 10/2002 Yasuda et al. ..... 209/534

* cited by examiner

*Primary Examiner*—Donald P. Walsh
*Assistant Examiner*—Mark J. Beauchaine
(74) *Attorney, Agent, or Firm*—Rabin & Berdo, P.C.

(57) ABSTRACT

A paper currency receiver for use in a ticket vending machine, money exchange machine, or the like is constructed to include a housing with a paper currency insertion slot, and a detector unit formed of an upper base and a lower base and mounted in the housing and adapted for detecting the authenticity of paper currency inserted into the paper currency insertion slot, the detector unit defining an angled passage between the upper base and the lower base for guiding inserted paper currency away from the paper currency insertion slot to a paper currency storage cabinet, the lower base having a pivoted safety hook turned in and out of the angled passage for stopping backward movement of inserted paper currency.

5 Claims, 6 Drawing Sheets

PAPER CURRENCY RECEIVER FOR TICKET VENDOR

BACKGROUND OF THE INVENTION

1. Field of the Invention

The present invention relates to a paper currency receiving system for use in a ticket vending machine, money exchange machine, or the like and, more particularly to such a paper currency receiver, which effectively prohibits people from pulling back inserted paper currency.

2. Description of the Related Art

FIG. 4 illustrates a prior art paper currency receiver for use in a ticket vending machine, money exchange machine, or the like. According to this design, the paper currency receiver comprises a housing C with a paper currency insertion slot C1, a transmission mechanism E installed in the housing C and adapted for transferring inserted paper currency away from the paper currency insertion slot C1 to a paper currency passage C2 and then a paper currency storage cabinet (not shown), and a circuit board D installed in the housing C and adapted for detecting the authenticity of inserted paper currency. The housing C comprises a toothed safety plate F provided at the paper currency passage C2 for prohibiting backward movement of inserted paper currency. This design of paper currency receiver is still not satisfactory in function. If inserted paper currency is pulled backwards with a metal string or an external body, inserted paper currency will be torn or damaged by the toothed safety plate.

SUMMARY OF THE INVENTION

The present invention has been accomplished to provide a paper currency receiver, which eliminates the aforesaid problem. It is the main object of the present invention to provide a paper currency receiver, which effectively prohibits people from pulling back inserted paper currency without causing damage to inserted paper currency. According to one aspect of the present invention, the paper currency receiver comprises a housing with a paper currency insertion slot, and a detector unit formed of an upper base and a lower base and mounted in the housing and adapted for detecting the authenticity of paper currency inserted into the paper currency insertion slot. The detector unit defines an angled passage between the upper base and the lower base for guiding inserted paper currency away from the paper currency insertion slot to a paper currency storage cabinet. The lower base comprises a pivoted safety hook turned in and out of the angled passage for stopping backward movement of inserted paper currency. According to another aspect of the present invention, the lower base comprises sensor means disposed adjacent to the angled passage and adapted to control turning of the safety hook into the active position subject to the presence of paper currency in the angled passage.

DETAILED DESCRIPTION OF THE PREFERRED EMBODIMENT

Figure 1:
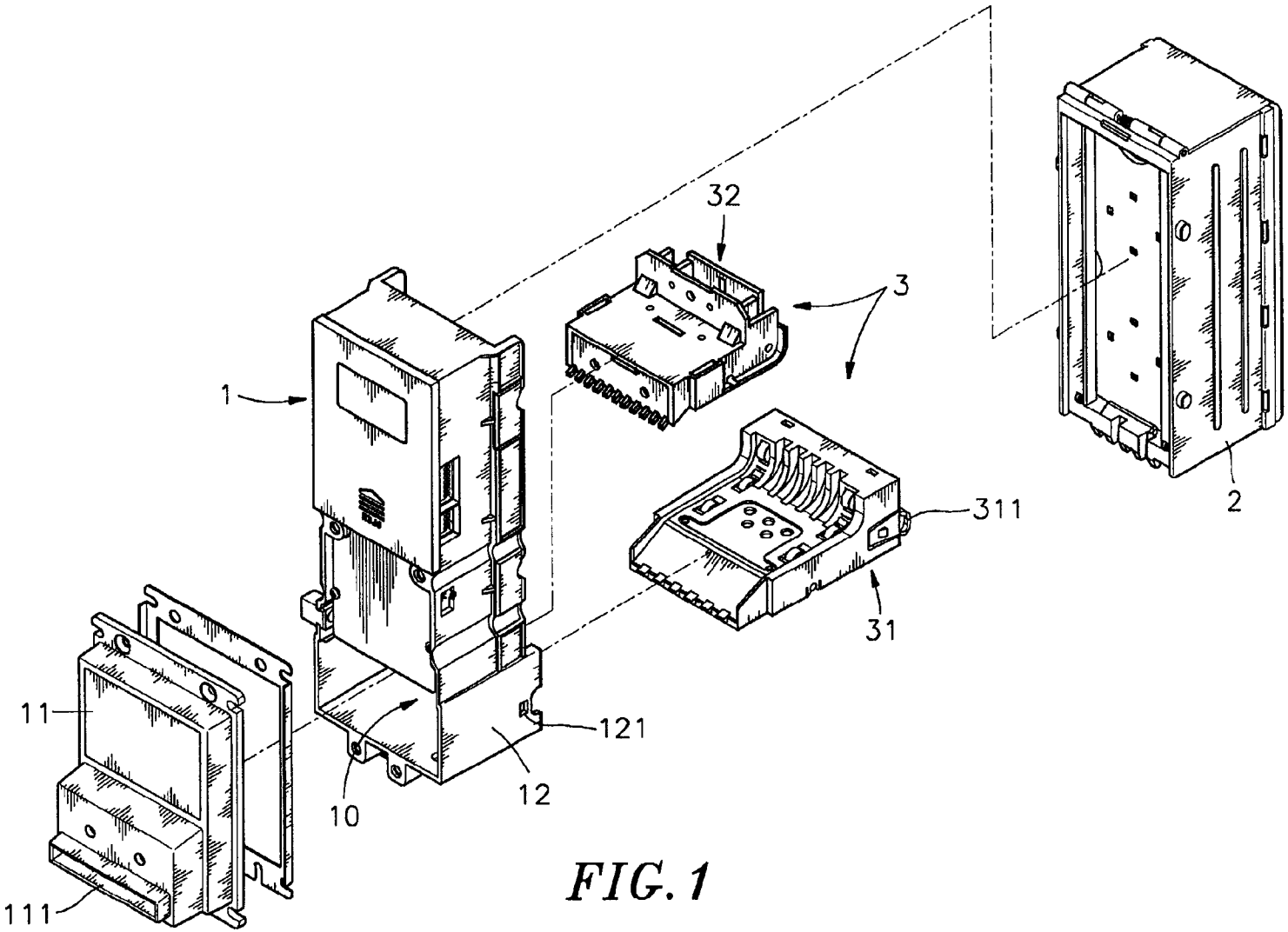
FIG. 1 is an exploded view of a paper currency receiver constructed according to the present invention.

Referring to FIGS. from 1 through 3, a paper currency receiver in accordance with the present invention is shown comprised of a housing 1, a paper currency storage cabinet 2, and a detector unit 3. The housing 1 is adapted for accommodating the detector unit 3, having a face panel 11 provided at the front side. The face panel 11 has an insertion slot 111 for entry of paper currency. The detector unit 3 detects the authenticity of paper currency inserted into the insertion slot 111. A conveyer 4 and a paper currency impression mechanism 5 are provided inside the housing 1. The conveyer 4 comprises conveying belts 41, wheel holders 42 provided in between the conveying belts 41, and idle wheels 421 respectively pivoted to the wheel holders 42. The conveyer 4 transfers inserted paper currency from the angled passage 30 to the paper currency storage cabinet 2. The paper currency impression mechanism 5 holds down transferred paper currency for smooth delivery.

The detector unit 3 is comprised of an upper base 31 and a lower base 32. The upper base 31 comprises two spring hooks 311 respectively provided at the rear ends of the two opposite lateral sides thereof and adapted for hooking in respective hook holes 121 in the two side panels 12 of the lower chamber 10 of the housing 1. After installation in the housing 1, the upper base 31 and the lower base 32 define the angled passage 30 for the passing of inserted paper currency. The lower base 32 comprises a pivoted safety hook 321 and a sensor 322 respectively provided adjacent to the angled passage 30. The safety hook 321 has a free end terminating in a protruded stop flange 3211, which effectively prohibits burglars from catching inserted paper currency.

Figure 3:
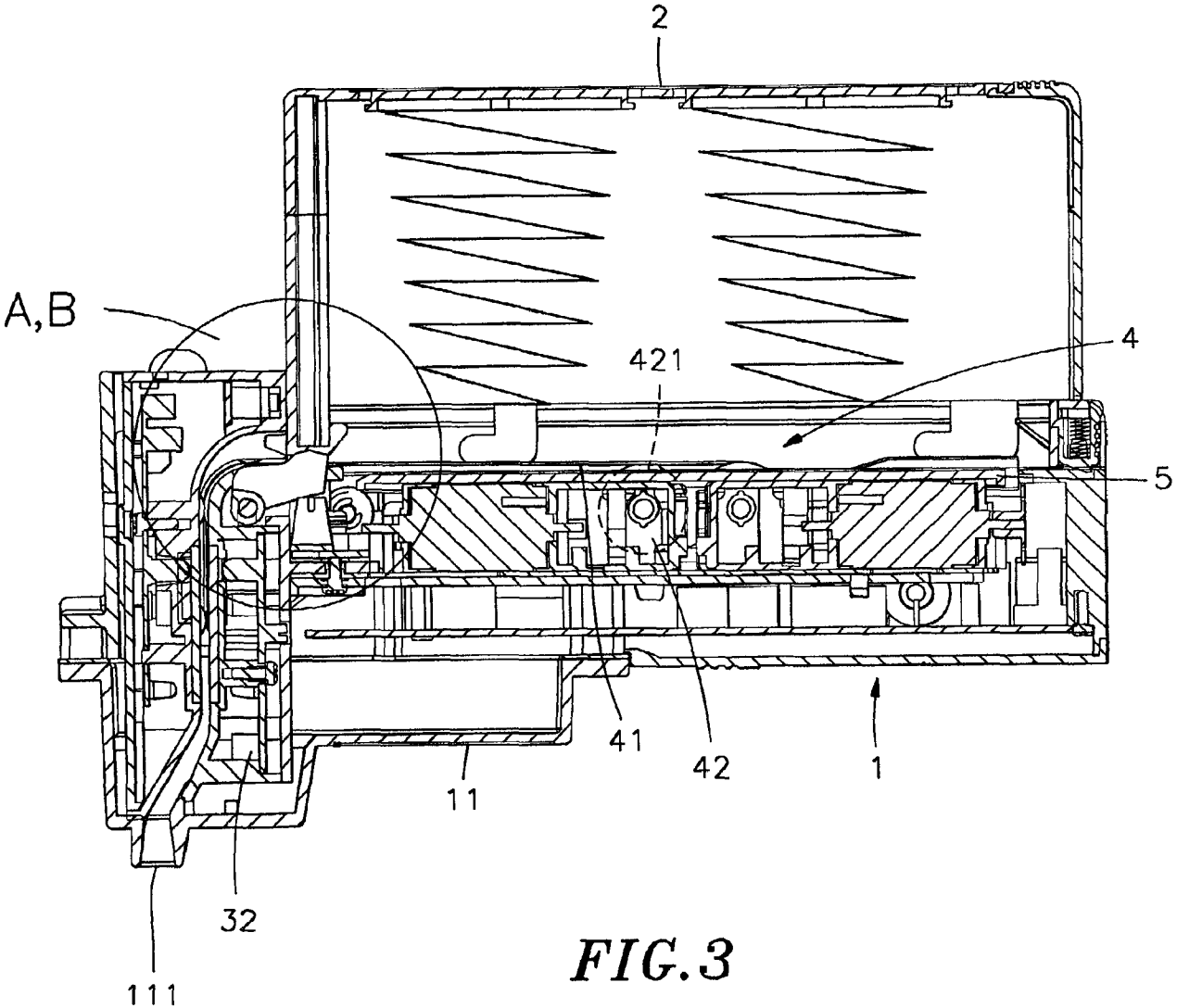
FIG. 3 is a sectional view of the paper currency receiver according to the present invention.
Figure 3A:
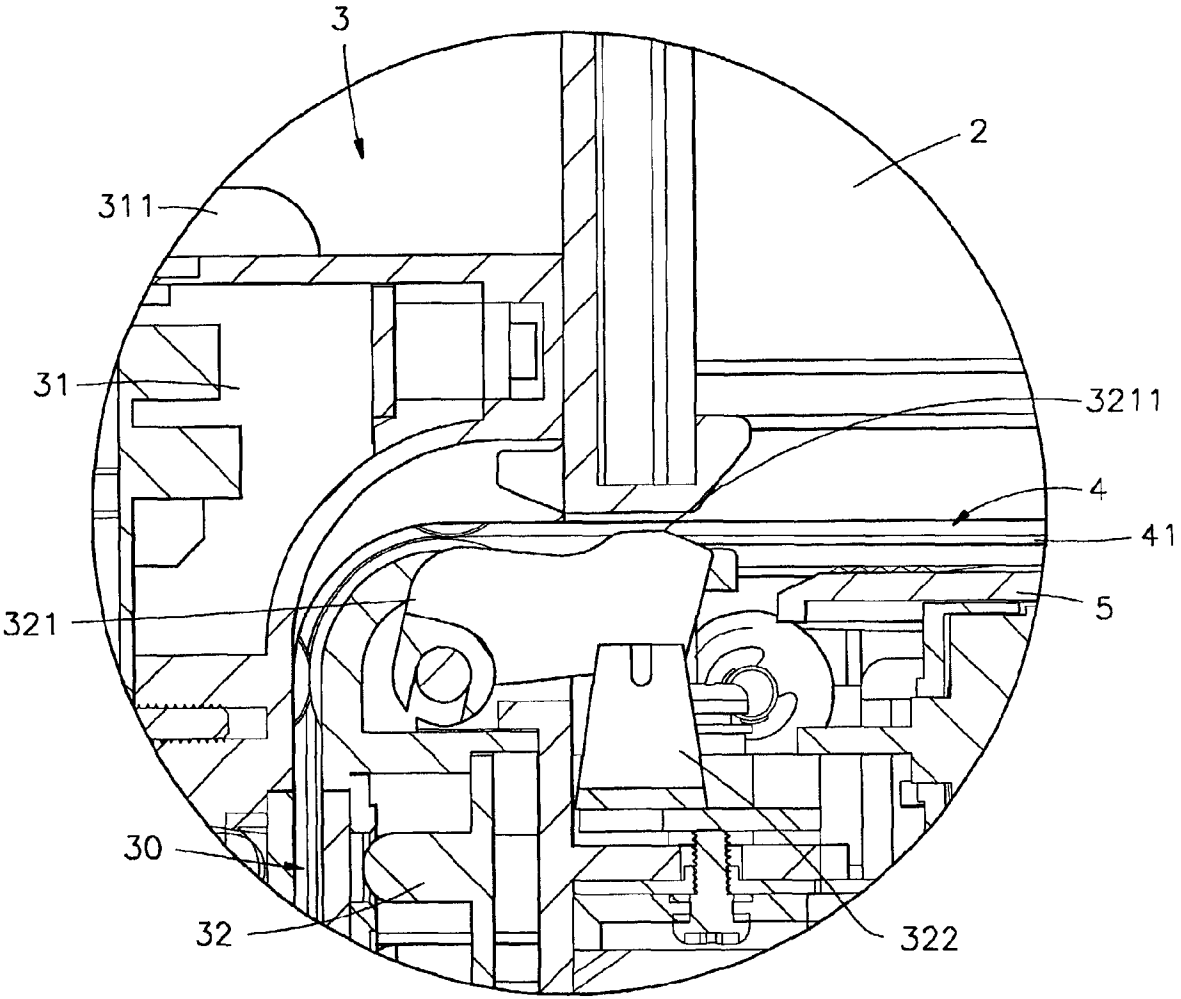
FIG. 3A is an enlarged view of a part of FIG. 3.
Figure 3B:
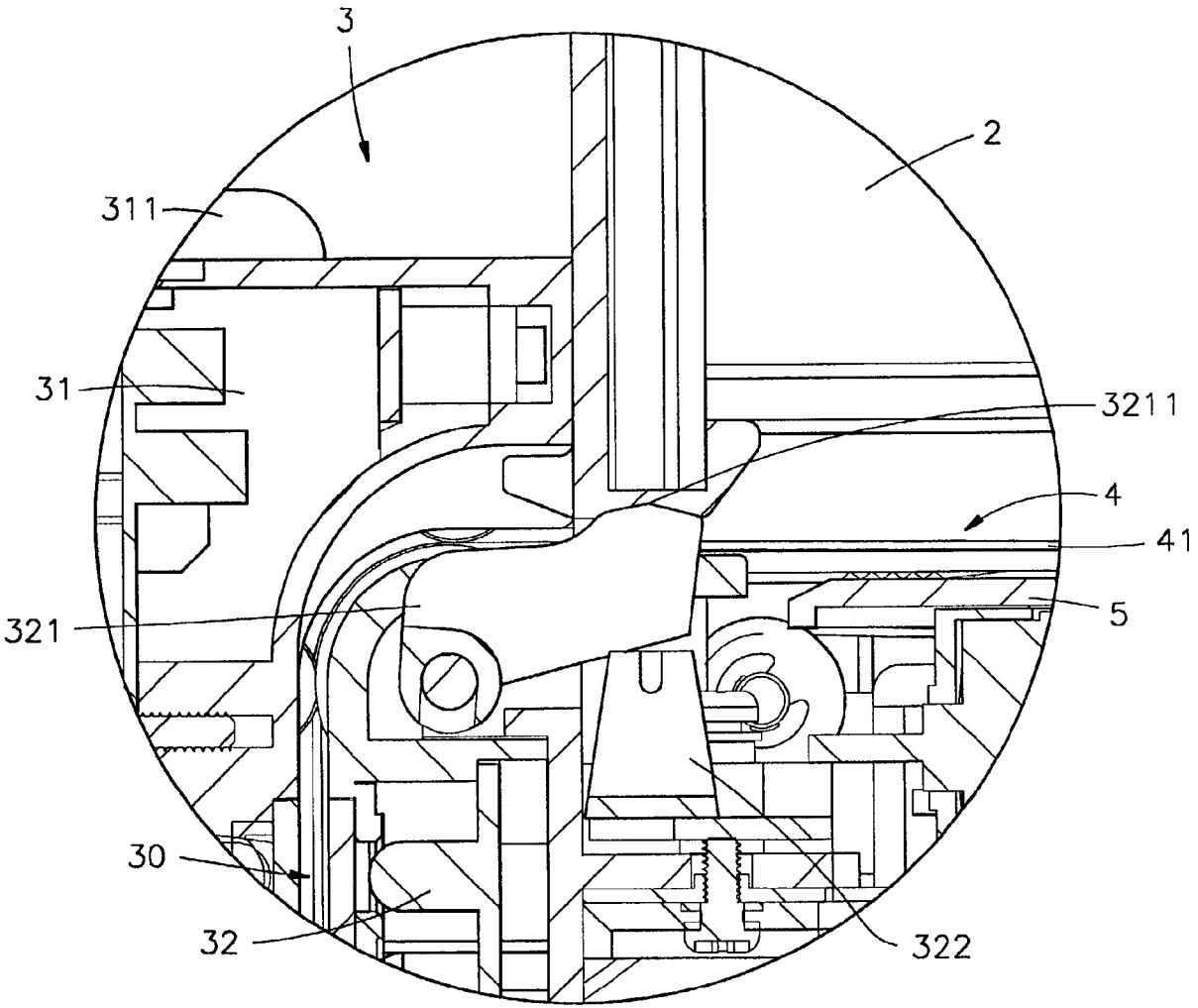
FIG. 3B is similar to FIG. 3A but showing the safety hook turned to the active position.
Figure 4:
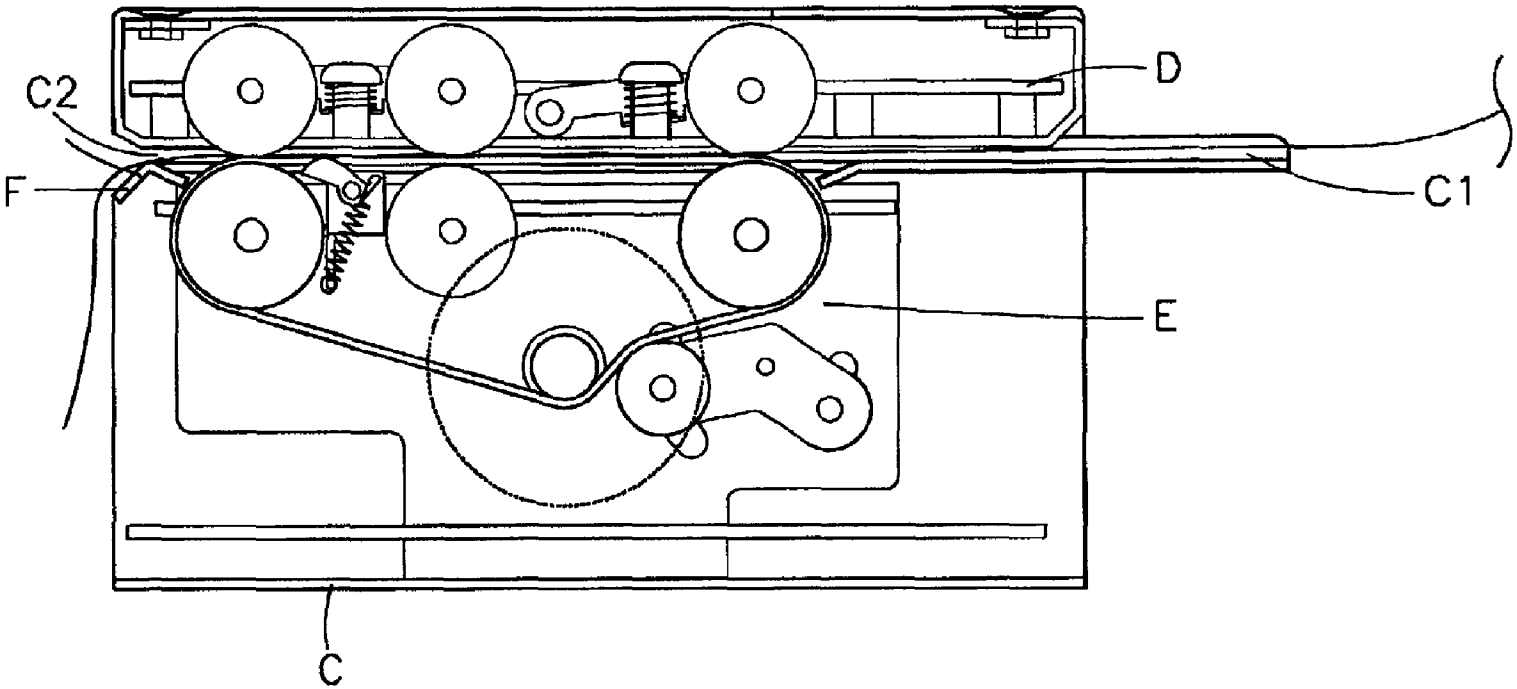
PRIOR ART FIG. 4
FIG. 4 is a sectional view of a paper currency receiver constructed according to the prior art.

Referring to FIGS. 3, 3A, and 3B, the detector unit 3 is mounted in the lower chamber 10 of the housing 1. When the upper base 31 and the lower base 32 aligned in the lower chamber 10 of the housing 1, the detector unit 3 produces a detection signal to detect authenticity of paper currency inserted into the insertion slot 111. When the authenticity of inserted paper currency verified, the sensor 322 imparts a signal to turn the pivoted safety hook 321 in one direction to stop backward movement of inserted paper currency with a cord member, tape, or metal string that was attached to inserted paper currency by the burglar. Because the vertical section of the angled passage 30 and the insertion slot 111 are not disposed at the same plane, a burglar cannot easily pull back inserted paper currency.

Figure 2:
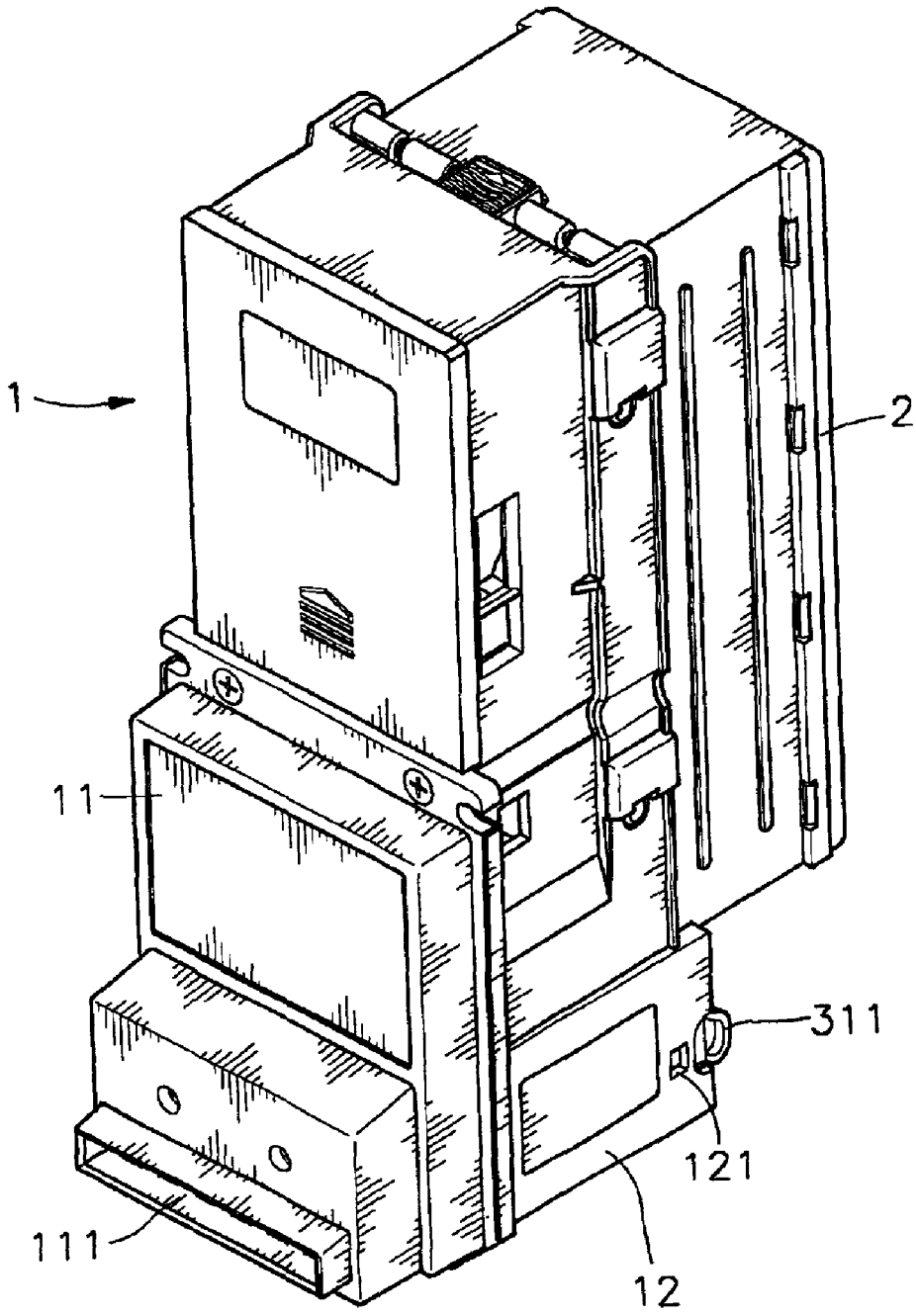
FIG. 2 is an assembly view of the paper currency receiver according to the present invention.

A prototype of paper currency receiver has been constructed with the features of the annexed drawings of FIGS. 1~3. The paper currency receiver functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A paper currency receiver, comprising:

a housing including a face panel having an insertion slot therein; and a detector unit mounted in said housing and adapted to detect an authenticity of paper currency inserted into the insertion slot, said detector unit including an upper base, and a lower base, with an angled passage being defined between said upper base and said lower base, the angled passage being adapted for guiding inserted paper currency away from the insertion slot, said lower base comprising a pivoted safety hook turned in and out of the angled passage between two positions for stopping a backward movement of inserted paper currency, said lower base further comprising sensor means disposed adjacent to the angled passage and adapted to control the turning of said safety hook between the two positions subject to a presence of paper currency in the angled passage.

2. The paper currency receiver as claimed in claim 1, wherein said housing comprises a chamber adapted for accommodating said detector unit, said chamber having a plurality of hook holes symmetrically disposed in two opposite side panels thereof; wherein said upper base comprises a plurality of spring hooks symmetrically disposed at two sides thereof and respectively hooked in the hook holes of said chamber of said housing.

3. The paper currency receiver as claimed in claim 1, further comprising a paper currency storage cabinet fastened to said housing and adapted for receiving paper currency transferred through the angled passage.

4. The paper currency receiver as claimed in claim 3, wherein said housing comprises a conveyer adapted to transfer inserted paper currency from the angled passage to said paper currency storage cabinet, and an impression mechanism adapted to hold down paper currency being transferred by said conveyer.

5. The paper currency receiver as claimed in claim 1, wherein said pivoted safety hook has a free end terminating in a protruded stop flange.

* * * * *